US007892039B2

(12) United States Patent
Feeney

(10) Patent No.: US 7,892,039 B2
(45) Date of Patent: Feb. 22, 2011

(54) CONNECTOR USABLE WITH MULTIPLE LAYERED CONNECTIONS AND METHOD OF USE THEREOF

(75) Inventor: Christopher John Feeney, Wallingford, CT (US)

(73) Assignee: GKN Aerospace Services Structures Corp., Cromwell, CT (US)

( * ) Notice: Subject to any disclaimer, the term of this patent is extended or adjusted under 35 U.S.C. 154(b) by 0 days.

(21) Appl. No.: 12/076,977

(22) Filed: Mar. 26, 2008

(65) Prior Publication Data

US 2008/0268716 A1 Oct. 30, 2008

Related U.S. Application Data

(60) Provisional application No. 60/907,238, filed on Mar. 26, 2007.

(51) Int. Cl.
*H01R 24/04* (2006.01)

(52) U.S. Cl. ..... 439/669

(58) Field of Classification Search ..... 439/669, 439/668

See application file for complete search history.

(56) References Cited

U.S. PATENT DOCUMENTS 2,762,025 A 9/1956 Melcher
5,240,437 A 8/1993 Christian
5,266,047 A 11/1993 Black et al.
6,210,339 B1 4/2001 Kiepen et al.
6,616,487 B1 * 9/2003 Lai ..... 439/668
6,988,915 B2 * 1/2006 Hirose ..... 439/668
7,094,088 B2 * 8/2006 Wang et al. ..... 439/188
7,217,163 B2 * 5/2007 Landgraf ..... 439/669
7,316,589 B1 * 1/2008 Rogers et al. ..... 439/668
7,404,743 B2 * 7/2008 Chen et al. ..... 439/669
7,407,416 B1 * 8/2008 Rogers et al. ..... 439/669
7,407,743 B2 * 8/2008 Hahn et al. ..... 435/4
7,500,882 B2 * 3/2009 Goetz et al. ..... 439/669

* cited by examiner

*Primary Examiner*—Gary F. Paumen
(74) *Attorney, Agent, or Firm*—Arent Fox LLP

(57) ABSTRACT

Various connectors are provided that allow establishment of one or more connections in minimal space. Numerous pins of typical radial pin related art connectors are replaced with longitudinally extending connector portions that are able to matingly engage a receiving connector portion. The connectors ease the initial manufacture of parts in which they are used, and allows the part to be more easily maintained, lighten the wiring system or harnessing system for the final product in which the part is incorporated over conventional connectors, and typically permit the harness and wiring system for the product to fit within an allotted envelope for size, weight, and other limitations.

16 Claims, 8 Drawing Sheets

CONNECTOR USABLE WITH MULTIPLE LAYERED CONNECTIONS AND METHOD OF USE THEREOF

This application claims priority from U.S. Patent Application No. 60/907,238, titled "Connector Usable with Multiple Layered Connections and Method of use Thereof," filed on Mar. 26, 2007. The contents of U.S. Patent Application No. 60/907,238 are hereby incorporated by reference in their entirety.

BACKGROUND OF THE INVENTION

1. Field of the Invention

Aspects of the present invention relates to a connector device and method of use thereof, and in particular to a connector device that allows connection to connection points in multiple layers of a composite or other material or part.

2. Background of the Related Art

There is a general need in the art of connectors for parts, such as electrical connectors for aircraft components, for such connectors to be robust, have minimal profile (e.g., cross-sectional size), minimal weight, and to allow simple replacement of the part being connected and the connector itself.

Conventional connectors are typically relatively heavy, compared to the wires or other components to which they are connected. Such conventional connectors generally contain numerous pins, such as in a radial pattern, to which individual wires must be individually connected, and are therefore often difficult to manufacture and to incorporate into more complex parts, such as parts comprised of composite materials and having multiple connection points or layers.

There remains a need for parts providing increased robustness and replaceability over prior art connectors.

SUMMARY OF THE INVENTION

Aspects of the present invention solve the above identified problems of the conventional art, as well as others, by providing various connectors that allow establishment of one or more connections in minimal space (e.g., cross sectional area of the connector). With various aspects of the present invention, the numerous pins of typical radial pin prior art connectors are replaced with longitudinally extending connector portions that are able to matingly engage a receiving connector portion.

Among other advantages, the connector in accordance with aspects of the present invention eases the initial manufacture of parts in which it is used, and allows the part to be more easily maintained (e.g., with replacement of the part and/or connector). Aspects of the connector of the present invention lighten the wiring system or harnessing system for the final product (e.g., an aircraft or any other vehicle) in which the part is incorporated over related art connectors, and typically permit the harness and wiring system for the product to fit within an allotted envelope for size, weight, and other limitations.

A first exemplary connector in accordance with aspects of the present invention includes a male connector portion and a female connector portion, the male connector portion being engageable with the female connector portion such that multiple couplings (e.g., electrical circuit paths or optical connections) are formed therebetween. The male portion of the first exemplary connector may include a base portion and single connector extension, the single connector extension possibly including a plurality of connector portions separated by insulator portions. In some variations, each connector portion or groups of the connector portions may have differing diameters, such that concentric, stepped extension levels are produced in the extension.

In the first exemplary connector, a female connector portion may include an opening for receiving the stepped or non-stepped extension of the male portion, with corresponding connector elements being contained within the opening so as to allow connection with the connection portions of the extension of the male connector portion. In addition, the female connector portion of some embodiments includes one or more connection points, such as solder pads, coupled to the connector elements.

A second exemplary connector is similar in design and function to the first exemplary connector, but includes a male connector portion having multiple extensions from the base portion. The female connector portion of this embodiment may include multiple openings for receiving the multiple male extensions of the male connector portion.

Among other uses, aspects of the connectors and connector portions of the present invention may be usable with aircraft composite part manufacturing, such as is disclosed in applicant's copending U.S. Provisional Patent Application No. 60/690,151 titled "HYDRAULIC PRESSURIZING CONTAINMENT VESSEL METHOD OF USE THEREOF" filed Jun. 14, 2005, and corresponding U.S. patent application Ser. No. 11/451,300 titled "HYDRAULIC PRESSURIZING CONTAINMENT VESSEL METHOD OF USE THEREOF" filed Jun. 13, 2006; U.S. Provisional Patent Application No. 60/814,075 titled "DEVICE FOR PREFORMING CONSOLIDATION AND METHOD OF USE THEREOF" filed Jun. 16, 2006; and U.S. Provisional Patent Application No. 60/801,046 titled "SMART COMPOSITES AND METHOD OF USE THEREOF" filed May 18, 2006, each of which is hereby incorporated in its entirety herein by reference.

Additional advantages and novel features in accordance with aspects of the invention will be set forth in part in the description that follows, and in part will become more apparent to those skilled in the art upon examination of the following or upon learning by practice of the invention.

BRIEF DESCRIPTION OF THE FIGURES

Various exemplary variations of this invention will be described in detail, with reference to the following figures, wherein.

DETAILED DESCRIPTION

Although the variations shown in the below figures are generally described in the context of electrical connection, the connectors may similarly be employed for optical or other connection applications. For example, rather than coupling electrical connections, the connector can connect optical paths.

These and other features and advantages of this invention are described in, or are apparent from, the following detailed description of various exemplary aspects of this invention.

Figure 1:
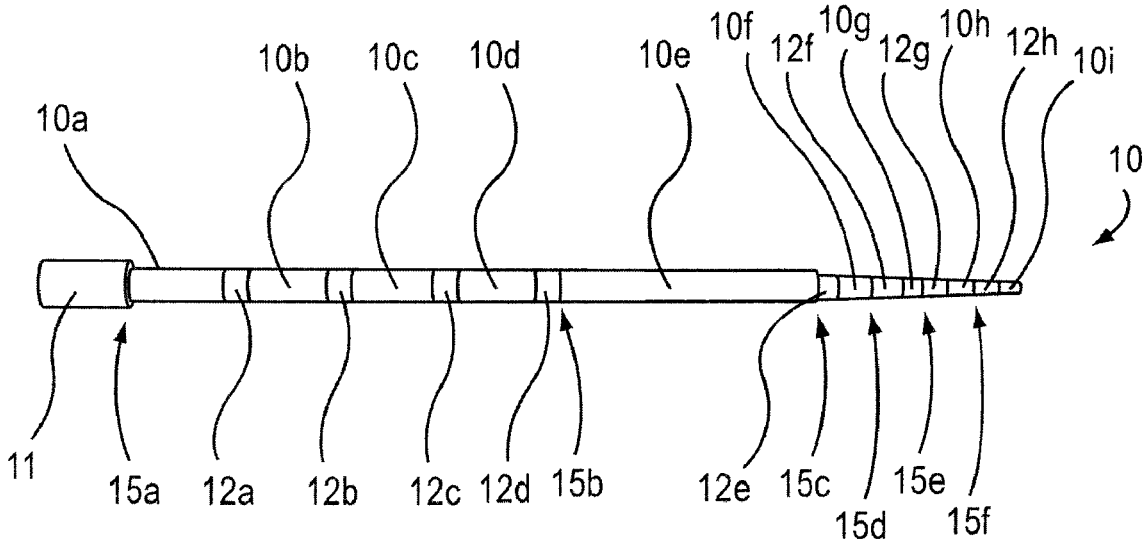
FIG. 1 shows a photostat of the male portion of a first exemplary connector, in accordance with aspects of the present invention.

FIG. 1 shows an image of an exemplary connector 10 (also interchangeably referred to herein as a "male connector portion") in accordance with an embodiment of the present invention. As shown in FIG. 1, the connector portion 10 of this exemplary variation of the present invention includes multiple circuits and has a general resemblance to a single pin connector.

As shown in FIG. 1, the connector portion 10 includes an end or attachment portion 11. In some variations, the attachment portion constitutes a graspable base portion for engaging the connection portion 10 into an opening in a corresponding female connector portion attachable to, incorporatable in, or otherwise associated with a part, such as a composite part having multiple layers of connection locations, into which the connector portion 10 is to be matingly coupled (the attachment portion 11 also interchangeably being referred to herein as a "base portion"). The connector portion 10 further includes a plurality of connector portions 10*a*-10*i* and a plurality of insulating portions 12*a*-12*h* for electrically insulating the connector portions 10*a*-10*i*. In some embodiments, the attachment portion 11 contains leads (e.g., wires for connection to a control or power circuit associated with the part to be connected) and is designed for strain relief while connected or during connection/disconnection with the female receiving portion (see, e.g., FIGS. 3A-3B below and accompanying description).

In the exemplary variation of FIG. 1, subgroups (e.g., one or more) of the plurality of connector portions 10*a*-10*i* and insulating portions 12*a*-12*h* are separated by grouping at differing cross-sectional diameters, such that a shoulder 15*a*-15*f* separates these subgroups. For example, in FIG. 1, a first shoulder 15*a* separates the attachment portion 11 from a first subgroup of connector portions 10*a*-10*d* and insulating portions 12*a*-12*d*; a second shoulder 15*b* separates the first subgroup from a second subgroup of connector portion 10*e*; a third shoulder 15*c* separates the second subgroup from a third subgroup of connector portion 10*f* and insulating portion 12*e*; a fourth shoulder 15*d* separates the third subgroup from a fourth subgroup of connector portion 10*g* and insulating portion 12*f*; a fifth shoulder 15*e* separates the fourth subgroup from a fifth subgroup of connector portion 10*h* and insulating portion 12*g*; and a sixth shoulder 15*f* separates the fifth subgroup from a sixth subgroup of connector portion 10*i* and insulating portion 12*h*. Alternatively, the connector portions and the insulation portions may all have the same or approximately the same outer diameter, with coupling via the attachment portions occurring via internal couplings or other features.

In operation, the connector portion 10 if FIG. 1 is inserted into a multiple shouldered opening, such as an opening in a female receiving portion incorporated in, coupled to, or otherwise associated with a multilayered composite part. The opening shoulders correspond to the shoulders 15*a*-15*f* of the connector portion 10 and allow mating engagement therewith. Between the shoulders of the opening are corresponding connector portions connected to the multiple shouldered opening.

Figure 2A:
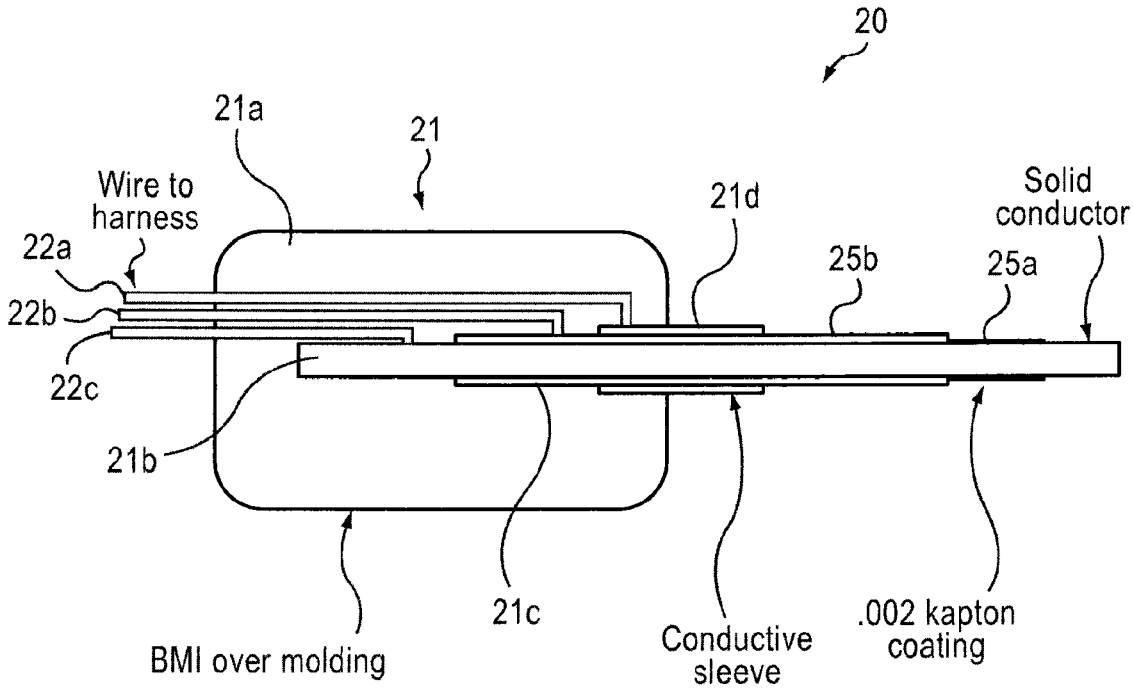
FIGS. 2A-2C contain representative views of the male portion of a second exemplary connector, in accordance with aspects of the present invention.
Figure 2B:
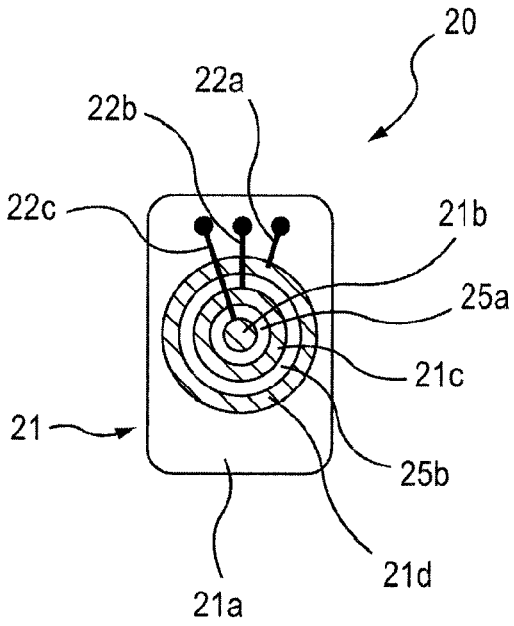
Figure 2C:
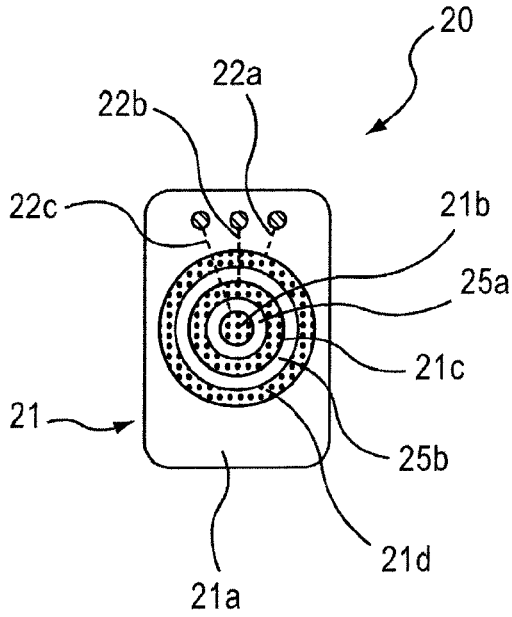
Figure 3A:
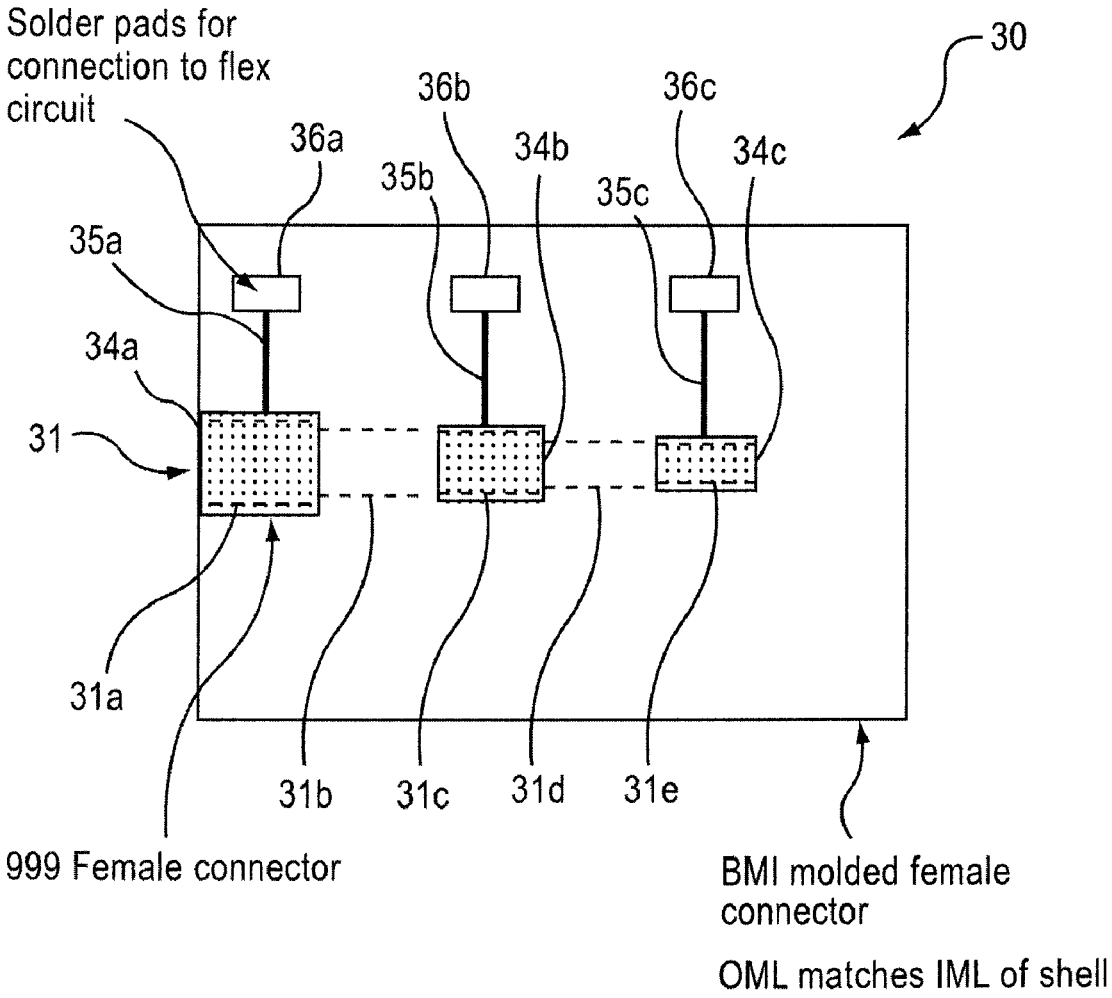
FIGS. 3A-3C show representative views of the female portion of an exemplary connector, in accordance with aspects of the present invention, that is usable, for example, with the male portion of the connector shown in FIGS. 2A-2C.
Figure 3B:
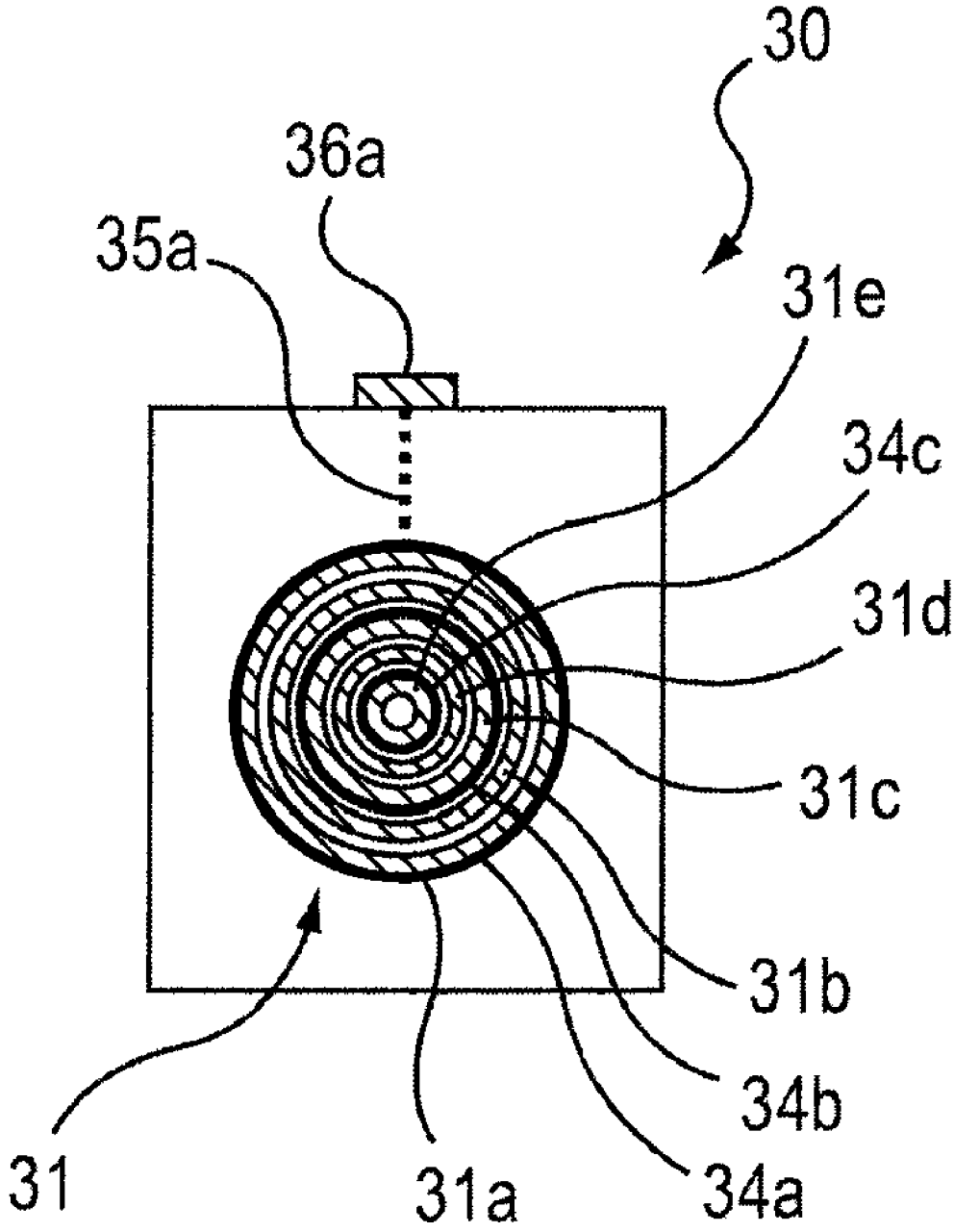
Figure 3C:
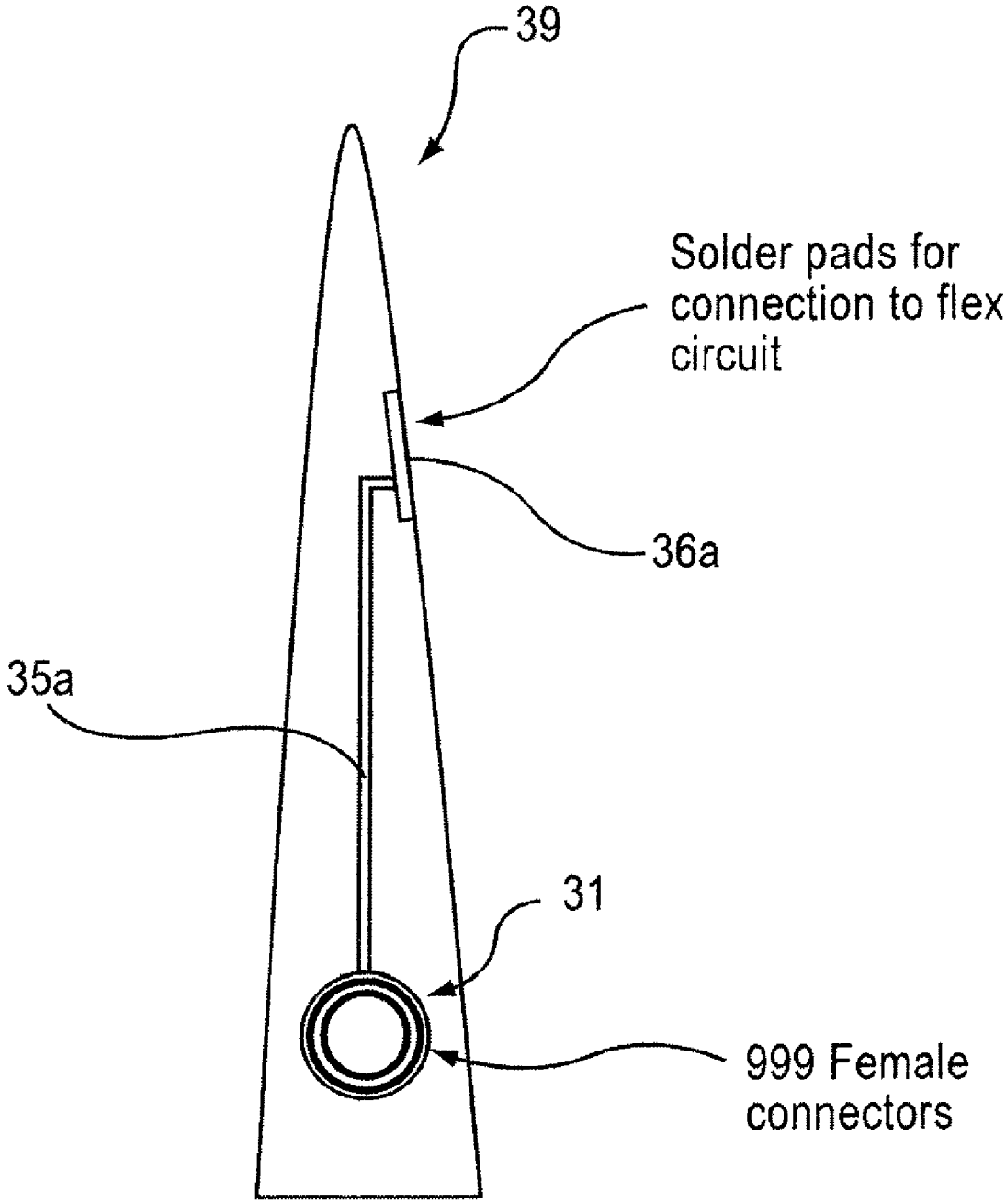

To further illustrate aspects of the present invention, FIGS. 2A-2C contain representative diagrams of a male connector portion usable with a female receiving portion incorporated in, coupled to, or otherwise associated with a part to receive the male connector portion, such as the female connector portions shown in FIGS. 3A-3C. FIG. 2A presents a side representative view of an embodiment of a male connector portion 20 that includes an attachment portion 21 frictionally fittable into or against, or otherwise engageable with, a matingly receiving opening. In the exemplary variation shown in FIG. 2, the attachment portion 21 includes a molding portion 21*a*, stepped (also interchangeably referred to herein as "sleeved") portions 21*b*-21*d*, and a plurality of leads 22*a*-22*c* coupled (e.g., electrically connected) to the corresponding steps of the stepped portions 21*b*-21*d*. The leads 22*a*-22*c*, in turn, are coupleable to another component or components. For example, if the part containing the connector portion 20 and the receiving opening is a part in an aircraft or any other vehicle, and the connector portion 20 is for electrically communicating information or supplying heating electricity, for example, to the receiving opening of the part, the connector may connect via the leads 22*a*-22*c* to a controller, a processor, or an electricity source for generating heating current.

FIGS. 2B and 2C show end views of the connector 20 of FIG. 2A. FIG. 2B illustrates a representative cutaway end view from the end containing the attachment portion 31 of the connector 20, showing sleeved connector layers 21*b*, 21*c*, 21*d* separated by insulating layers 25*a*, 25*b*. FIG. 2C shows an end view of the connector 20 from the end opposite the attachment portion 21. As shown in FIG. 2C, connector layer 21*b* is solid and circularly cross-sectionally shaped, connector layers 21*c*, and 21*d* are circularly cross-sectionally sleeve shaped, and insulating layers 25*a*, 25*b* are circularly cross-sectionally sleeve shaped. Insulating layer 25*a* isolates (e.g., electrically) connector layer 21*b* from connector layer 21*c*, and insulating layer 25*b* isolates (e.g., electrically) connector layer 21*c* from connector layer 21*d*.

FIG. 3A illustrates a side view of a representative receiving connector portion 30 (also referred to interchangeably herein as a "female connector portion") for a part, such as an aircraft or vehicle composite part, having a receiving opening 31 for receiving the shouldered extending connector layers and insulating layers of the male connector portion 20 of FIGS. 2A-2C. As shown in FIG. 3A, the opening 31 includes a series of stepped sections 31*a*-31*e* corresponding to the connector layers 21*b*-21*d* and insulating layers 25*a*, 25*b* of the connector 20 of FIGS. 2A-2C. For those stepped sections 31*a*, 31*c*, 31*e* to be connected to connector layers of the connector, connector elements 34*a*, 34*b*, 34*c* are provided that are coupled 35*a*, 35*b*, 35*c* (e.g., by connecting circuit paths) to connection points 36*a*, 36*b*, 36*c*, such as solder pads for connection to a flex circuit for connecting to components or other portions of the part in which the receiving connector 30 is emplaced or to which the receiving connector 30 is otherwise coupled.

FIG. 3B shows an end view of the female connector 30 from the end containing the opening 31, including stepped sections 31*a*, 31*b*, 31*c*, 31*d*, 31*e*, connector elements 34*a*, 34*b*, 34*c*, couplings 35*a*, 35*b*, 35*c*, and connection points 36*a*, 36*b*, 36*c*.

FIG. 3C presents a cross-sectional side view of an exemplary part 39 containing the female connector receiving opening 31 and showing a coupling 35*a* to an exemplary connection point 36*a*, in accordance with aspects of the present invention.

Figure 4:
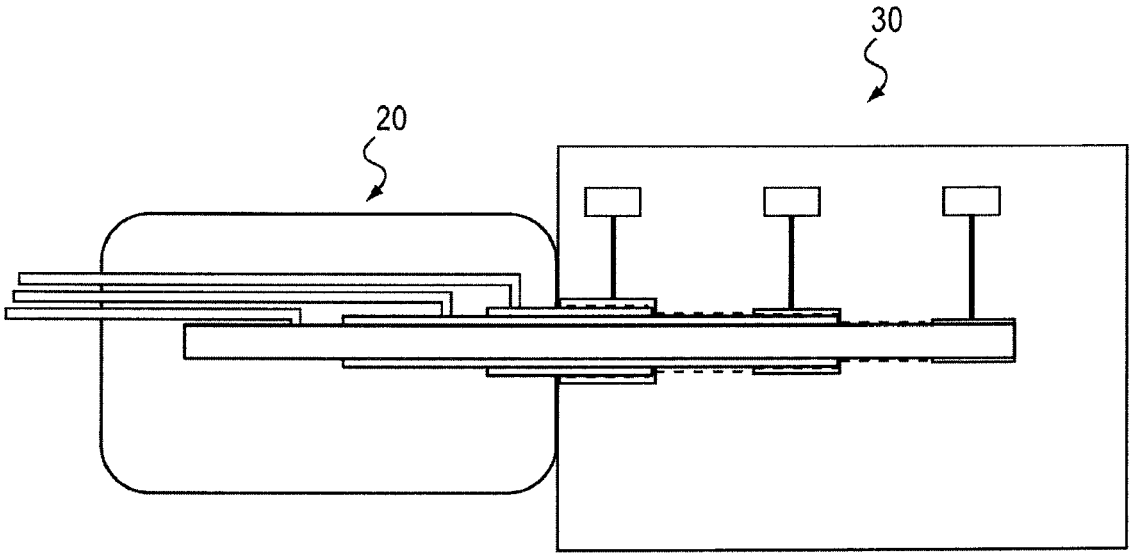
FIG. 4 shows the exemplary male connector of FIGS. 2A-2C matingly engaged with the female connector of FIGS. 3A-3B, in accordance with aspects of the present invention.

FIG. 4 shows the exemplary male connector 20 of FIGS. 2A-2C matingly engaged with the female connector portion 30 of FIGS. 3A-3C.

Figure 5:
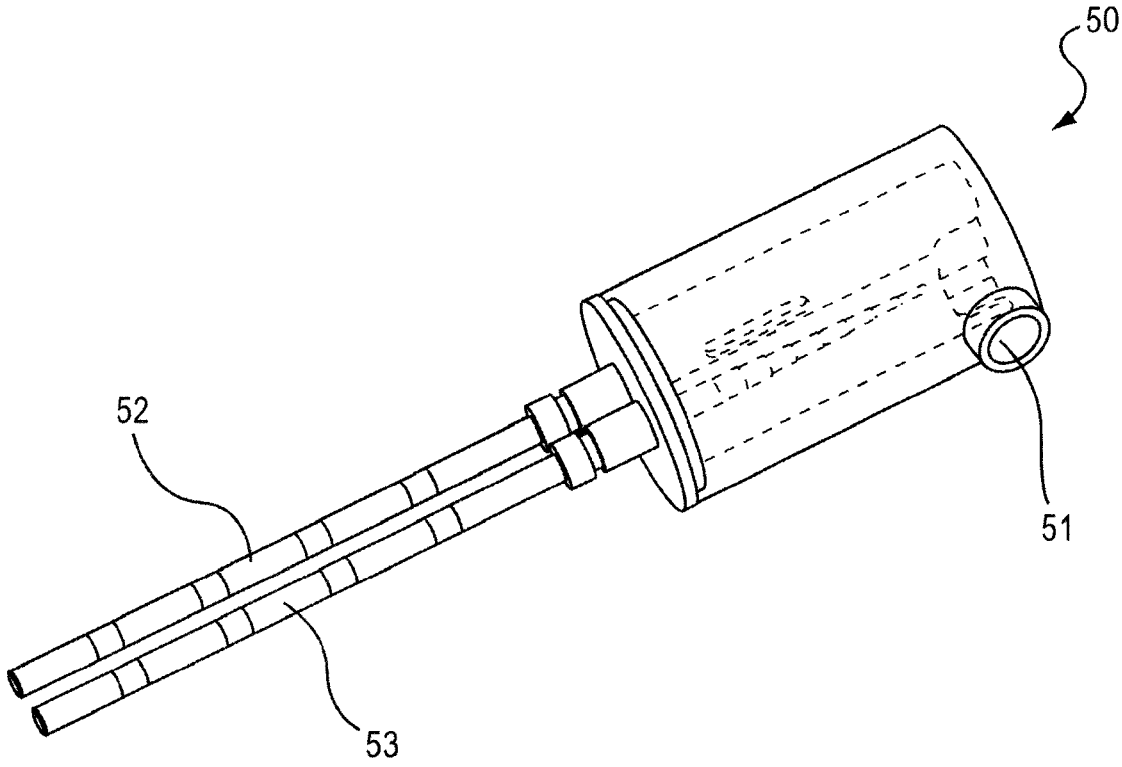
FIG. 5 shows another male portion of an exemplary connector having two extending portions, in accordance with aspects of the present invention.

FIG. 5 shows another exemplary embodiment of a connector 50 in accordance with aspects of the present invention. Similarly to the connectors of FIGS. 1-4, the connector 50 of FIG. 5 includes electrically or otherwise isolated connection portions alternating with insulator portions, but extending in two extensions 52, 53. A base portion 51 includes wiring and other circuit portions, such as connection points.

Although exemplary aspects of the present invention have now been discussed in accordance with the above advantages, it will be appreciated by one of ordinary skill in the art that these examples are merely illustrative of aspects of the present invention and that numerous variations and/or modifications may be made without departing from the spirit or scope thereof.

What is claimed is:

1. A connector system providing interchangeable electrical communication among aircraft components comprising an aircraft component having a connector assembly portion, the connector assembly portion comprising:

an attachment portion;

a plurality of aircraft connector portions coupled to the attachment portion, the plurality of aircraft connector portions being part of an aircraft control sensor or power circuit upon the circuit being completed; and at least one insulator portion attached to at least two of the plurality of aircraft connector portions in a longitudinal direction; wherein the plurality of aircraft connector portions and the insulator portions are alternately disposed in an axial direction of the connector assembly portion, one of the plurality of aircraft connector portions is disposed in the axial direction through a radial center of the connector assembly portion; and the attachment portion includes a connection coupling one or more of the aircraft connector portions within the aircraft control sensor or power circuit.

2. The connector system of claim 1, wherein at least two of the plurality of aircraft connector portions of the aircraft component are insulated from each other by one or more of the insulator portions.

3. The connector system of claim 1, wherein at least one of the aircraft connector portions and the at least one insulator portion are separated by at least one shoulder.

4. The connector system of claim 1, wherein the attachment portion comprises a plurality of sleeved portions, each of at least one of the plurality of sleeved portions being coupled to at least one of a plurality of electrical leads that can be coupled to another component.

5. The connector system of claim 4, wherein one or more of the plurality of electrical leads are controlled by at least one selected from a group consisting of a controller, a processor and a power source.

6. The connector system of claim 1, wherein each of the plurality of aircraft connector portions has a diameter, and wherein the diameters of the plurality of aircraft connector portions increase in size from one end to an opposite end of the connector assembly portion.

7. The connector system of claim 1, wherein each of the plurality of aircraft connector portions and each of the at least one insulator portion have a circular cross-sectional shape.

8. A connector system apparatus providing interchangeable electrical communication among aircraft components, the system comprising:

a first aircraft component having a connector assembly portion that comprises:

an attachment portion;

a plurality of aircraft connector portions attached to the attachment portion, the plurality of aircraft connector portions being part of an aircraft control sensor or power circuit upon the circuit being completed; and at least one insulator portion attached to at least two of the plurality of aircraft connector portions in a longitudinal direction; wherein the plurality of aircraft connector portions and the at least one insulator portions are alternately disposed in an axial direction of the connector assembly portion, one of the plurality of aircraft connector portions is disposed in the axial direction through a radial center of the connector assembly portion; and the attachment portion includes a connection coupling at least one of the plurality of aircraft connector portions within the aircraft control sensor or power circuit; and a second aircraft component comprising:

a plurality of receiving portions in which the aircraft connector portions of the first aircraft component can be inserted and form at least one electrical circuit.

9. The connector system of claim 8, wherein the second aircraft component is designed to matingly engage the first aircraft component.

10. The connector system of claim 8, wherein each of the plurality of receiving portions comprises a shouldered opening.

11. The connector system of claim 10, wherein the plurality of shouldered openings for the plurality of receiving portions are configured to receive the plurality of aircraft connector portions.

12. The connector system of claim 10, wherein each of the plurality of shouldered opening for the receiving portions is configured to matingly receive a corresponding one of the plurality of aircraft connector portions.

13. The connector system of claim 8, wherein the plurality of receiving portions of the second aircraft component form a female portion, and wherein the at least one aircraft connector portion of the first aircraft component forms a male portion, the female and male portions being matingly engageable.

14. The connector system of claim 13, wherein the female portion of the second aircraft component comprises an opening having a plurality of stepped sections for receiving the plurality of aircraft connector portions.

15. The connector system of claim 8, wherein the first aircraft component and the second aircraft component are easily attached to or detached from each other.

16. A connector system providing interchangeable electrical communication among vehicle components comprising:

a first vehicle component having a connector assembly portion that comprises:

an attachment portion;

a plurality of vehicle connector portions attached to the attachment portion, the plurality of vehicle connector portions being part of a vehicle control sensor or power circuit upon the circuit being completed; and at least one insulator portion attached to at least two of the plurality of vehicle connector portions in a longitudinal direction; wherein the plurality of vehicle connector portions and the at least one insulator portions are alternately disposed in an axial direction of the connector assembly portion, one of the plurality of vehicle connector portions is disposed in the axial direction through a radial center of the connector assembly portion; and the attachment portion includes a connection coupling at least one of the plurality of vehicle connector portions within the vehicle control sensor or power circuit; and a second vehicle component comprising:

a plurality of receiving portions in which the vehicle connector portions are inserted to form at least one electrical circuit.

* * * * *